US007325618B2

(12) United States Patent
Simpson et al.

(10) Patent No.: US 7,325,618 B2
(45) Date of Patent: Feb. 5, 2008

(54) TUBING EXPANSION TOOL

(75) Inventors: Neil Andrew Abercrombie Simpson, Aberdeen (GB); William Ball Roy, Banchory (GB)

(73) Assignee: Weatherford/Lamb, Inc., Houston, TX (US)

( * ) Notice: Subject to any disclaimer, the term of this patent is extended or adjusted under 35 U.S.C. 154(b) by 363 days.

(21) Appl. No.: 10/913,791

(22) Filed: Aug. 6, 2004

(65) Prior Publication Data

US 2005/0115719 A1 Jun. 2, 2005

(30) Foreign Application Priority Data

Aug. 8, 2003 (GB) ..... 0318573.3

(51) Int. Cl.
*E21B 23/00* (2006.01)

(52) U.S. Cl. ..... 166/380; 166/207; 166/212

(58) Field of Classification Search ..... 166/207, 166/212, 380, 382
See application file for complete search history.

(56) References Cited

U.S. PATENT DOCUMENTS

| | | | | |
|---|---|---|---|---|
| 3,477,508 | A | 11/1969 | Hurd | |
| 5,031,699 | A | 7/1991 | Artynov et al. | |
| 6,012,523 | A * | 1/2000 | Campbell et al. | 166/277 |
| 6,695,065 | B2 * | 2/2004 | Simpson et al. | 166/384 |
| 6,702,030 | B2 | 3/2004 | Simpson | |
| 6,712,151 | B2 | 3/2004 | Simpson et al. | |
| 7,063,149 | B2 | 6/2006 | Simpson et al. | |
| 7,114,559 | B2 | 10/2006 | Sonnier et al. | |
| 7,156,182 | B2 * | 1/2007 | Lynde et al. | 166/382 |
| 2003/0051885 | A1 | 3/2003 | Simpson et al. | |
| 2003/0141074 | A1 * | 7/2003 | Freeman | 166/380 |

FOREIGN PATENT DOCUMENTS

| | | |
|---|---|---|
| WO | WO 97/17524 | 5/1997 |
| WO | WO 02/073000 | 9/2002 |
| WO | WO 02090713 | 11/2002 |
| WO | WO 03/064813 | 8/2003 |
| WO | WO 2004/097169 | 11/2004 |

OTHER PUBLICATIONS

GB Search Report dated Nov. 6, 2003 from GB Application No. 0318573.3.

* cited by examiner

*Primary Examiner*—Hoang Dang
(74) *Attorney, Agent, or Firm*—Patterson & Sheridan, L.L.P.

(57) ABSTRACT

The invention relates to a tubing expansion tool including an expansion member which is movable between a first configuration and a larger expansion configuration for expanding tubing, and to a corresponding method.

In one embodiment of the invention, a tubing expansion tool (10) is disclosed for expanding a length of expandable tubing such as expandable sand exclusion tubing (12). The tool (10) comprises an expansion member (16) adapted for movement between a first configuration and a larger expansion configuration, and means (17) for exerting a cyclical expansion force on the expansion member (16).

75 Claims, 1 Drawing Sheet

TUBING EXPANSION TOOL

CROSS-REFERENCE TO RELATED APPLICATIONS

This application claims benefit of Great Britain patent application serial number GB 0318573.3, filed Aug. 8, 2003, which is herein incorporated by reference.

BACKGROUND OF THE INVENTION

1. Field of the Invention

The present invention relates to a tubing expansion tool and to a method of expanding tubing. In particular, but not exclusively, the present invention relates to a tubing expansion tool including an expansion member which is movable between a first configuration and a larger expansion configuration, and to a corresponding method.

2. Description of the Related Art

In the oil and gas exploration and production industry, a borehole of an oil or gas well is traditionally formed by drilling a bore from a wellhead to a first depth, and lining the drilled bore with a metal casing. The annulus between the casing and the borehole wall is then sealed with cement. The borehole is then extended, by drilling a smaller diameter bore from the upper cased section to a second depth. A smaller diameter casing is then installed from the wellhead, extending through the larger diameter casing to the second depth, and the second casing is then also cemented. This procedure is repeated until the borehole has been cased to a desired depth.

There has been considerable research in recent years into the development of expandable downhole tubing. The types of tubing developed include solid walled tubing, slotted or otherwise perforated tubing and expandable tubing-based sand exclusion assemblies, such as that disclosed in International Patent Publication WO 97/17524 (Shell), and as is available under the Applicant's ESS Trademark.

The introduction of expandable tubing has required the development of specialised expansion tools, some of which exert relatively high levels of torque and/or linear force on the tubing during an expansion process. However, the high levels of applied torque and force can cause problems both during and after expansion, particularly in the region of connections between tubing sections. For example, undesired deformation of the tubing, such as buckling, can occur due to a limited ability of the tubing to withstand the high levels of applied torque/force.

In one example of an existing method of expanding tubing, the applicant's International patent publication no. WO 02/103150 discloses locating an expansion cone in tubing to be expanded and applying impulses to the tool, to drive the tool through the tubing and expand the tubing to a larger diameter.

It is amongst the objects of embodiments of the present invention to provide an improved tubing expansion tool and method of expanding tubing. It is a further object of embodiments of the present invention to reduce or eliminate torque experienced by expandable tubing during an expansion process, such as in the areas of connections between expandable tubing sections.

SUMMARY OF THE INVENTION

According to a first aspect of the present invention, there is provided a tubing expansion tool comprising:

an expansion member adapted for movement between a first configuration and a larger expansion configuration; and means for exerting a cyclical expansion force on the expansion member.

The means for exerting a cyclical expansion force may be adapted to exert forces or force pulses of a desired amplitude or magnitude at a desired frequency, that is, a desired number of occurrences over a defined time period. The cycle of the force pulses with respect to time may, for example, be of a sinusoidal, generally square, random or any other suitable waveform. The waveform selected may depend upon factors including the physical parameters of the tubing to be expanded, existing casing, liner or the like, and properties of surrounding rock formations. The magnitude and frequency of the force pulses may vary over time, and may, for example, vary between a relatively low amplitude and/or frequency, such as at the start of an expansion procedure, and a relatively high amplitude and/or frequency, such as towards the end of an expansion procedure.

In preferred embodiments of the invention, the exertion of a cyclical expansion force on the expansion member facilitates rapid movement of the expansion member towards the expansion configuration, to exert a corresponding expansion force on tubing to be expanded. This facilitates expansion of the tubing without rotation of the expansion tool, and without the requirement to impart a large force upon the tool and consequently upon the tubing and thus connections between sections of the tubing, to translate the tool through the tubing. This in turn reduces the effects of the expansion process on the expansion tool and the tubing undergoing expansion. For example, rotary expansion tools may impart a significant torque upon the tubing, causing a corresponding deformation of the tubing in the downhole environment. It will however be understood that the tubing expansion tool may be rotated, and relatively large forces may be exerted on the tool to translate the tool through tubing, if desired or required.

In the first configuration, the expansion member may describe a first outer diameter or perimeter, and in the expansion configuration, a second, larger outer diameter or perimeter. Preferably, the expansion member is tubular and may be tapered. The expansion member may taper towards a leading end thereof, and may be generally conical, for example, the expansion member may comprise a truncated cone.

When the expansion member is cyclically urged towards the expansion configuration, the expansion member is repeatedly radially expanded against the tubing and induces a permanent deformation and increase in the diameter of the tubing. Translating the tapered expansion member through the tubing causes a progressive increase in the diameter of the tubing.

The expansion member may be tapered at a relatively small angle with respect to an axis of the tool. For example, at least part of an outer surface of the expansion member may be disposed at an angle of between 5-15 degrees with respect to an axis of the expansion tool. Providing an expansion member with such a shallow taper allows progressive, small expansions of the tubing.

Preferably, the expansion member is segmented and comprises a plurality of expansion member segments or parts, which together define the expansion member. The expansion member may therefore comprise a split cone. Each segment may interengage with or may be coupled to an adjacent segment, optionally in a sliding engagement or fit. This allows movement of the segments relative to each other and thus allows movement of the expansion member to the expansion configuration.

Each segment may be arcuate and axial edges of each segment may be shaped or formed to cooperate with respective axial edges of adjacent segments, to define a substantially complete circumference over a significant part of the member. Each segment may be castellated and may therefore comprise a plurality of teeth and recesses extending along at least part of a length of the axial edge, for engagement with corresponding recesses and teeth, respectively, of an adjacent segment. Accordingly, the segments can move with respect to one another during expansion, but remain in engagement. The teeth and recesses may be generally square or rectangular in shape. Alternatively, the axial edges of the segments may be of any other suitable profile.

The expansion tool may further comprise at least one further expansion member such as a cone or mandrel provided at a leading and/or trailing end of the expansion member, or on a separate part of the tool, for performing an initial and/or final expansion of the tubing. The other cone may be of a fixed diameter, semi-compliant or compliant (to describe a variable expansion diameter), or a combination thereof.

Preferably, the means for exerting a cyclical expansion force is fluid actuated. Thus, the expansion member may be urged towards the expansion configuration in response to applied fluid pressure and/or fluid flow with respect to or through the tool. The expansion member may therefore be actuatable in response to the inertia of a moving fluid column or other volume of fluid.

Alternatively or additionally, the means for exerting a cyclical expansion force may be mechanical or mechanically actuated, electromechanical (such as electromagnetic) or electro-mechanically actuated, or a combination thereof, or indeed any other suitable means.

Preferably also, the means for exerting a force comprises an expansion element adapted to be radially expanded to urge the expansion member towards the expanded configuration. The element may be located radially inwardly of the expansion member, and is preferably located within the expansion member. Accordingly, by exerting a force on the element, the expansion member is moved to the expansion configuration. The element may comprise an elastically deformable material and may comprise an elastomeric or rubber material.

The element may be inflatable and may be at least partly hollow, defining a chamber adapted for inflation in response to applied fluid pressure. Alternatively, the element may be substantially solid, and may be expandable by application of a force on the element in a predetermined direction. For example, the means for exerting a force may include a piston adapted to exert a compressive force on the forcing element in a direction along an axis of the tool, in response to applied fluid pressure, or may comprise a chamber for receiving fluid to apply a fluid pressure force to one or both axial ends of the element, inducing a radial expansion.

In alternative embodiments, the element may be tapered and may define a mandrel adapted to urge the expansion member to the expansion configuration. The element may be movable by application of fluid pressure either directly on the element or, for example, through an actuating piston. The mandrel may be of a fixed diameter or may be radially expandable.

In other embodiments, the element may comprise a cam and the expansion member may comprise a number of cam followers such as rollers or other elements adapted to be moved to the expansion configuration on rotation of the element.

The means for exerting a force may include a fluid flow controller or modulator, for controlling flow of fluid to the element, to control expansion of the element, or to the mandrel, piston or the like. The flow controller may be internal of a main part or body of the tool, or may be external, for example, at surface or further up a string of tubing coupled to the tool.

The flow controller may be fluidly coupled to the element. The flow controller may define a pulse generator and may be adapted to supply a pulse of pressurised fluid to the element. Also, the flow controller may be adapted to receive return flow of fluid from the element, or to allow a reduction in the pressure of fluid in the element, to allow the element to contract. Alternatively, the element may include a bleed valve or other means to allow pressure reduction. This allows subsequent further expansions generating further movements of the expansion member towards the expansion configuration.

Thus, by controlling the cycle of pressure pulses to the element, the element can be expanded and contracted. The flow controller may be adapted to provide a pulsed output to the element, and may be adapted to generate fluid pressure pulses in a determined cycle corresponding to a desired frequency of movement of the expansion member between the first and the expansion configurations.

The flow controller may be coupled to a fluid source, which may be adapted to supply fluid to the flow controller. Accordingly, the generation and frequency of the fluid pressure pulses may be controlled by the flow controller.

According to a second aspect of the present invention, there is provided an expansion member for expanding tubing, the expansion member movable between a first configuration and a larger expansion configuration, the expansion member adapted to be cyclically urged towards the expansion configuration.

Further features of the expansion member are defined above.

According to a fourth aspect of the present invention, there is provided a method of expanding tubing, the method comprising the steps of:

locating an expansion tool with respect to tubing to be expanded, with an expansion member of the tool in a first configuration;

exerting a cyclical expansion force on the expansion member, to urge the expansion member towards an expansion configuration; and translating the expansion tool relative to the tubing.

Preferably, the method comprises coupling a plurality of expansion member segments together to form the expansion member. The tool may include an element located within the expansion member, and the element may be expanded to urge the expansion member towards the expansion configuration. The element may be expanded by supplying pressurised fluid to the element and may be repeatedly expanded by supplying fluid pressure pulses to the element.

Alternatively, the element may be expanded by exerting a force upon the element. For example, the element may be expanded by supplying pressurised fluid to a piston, to exert a compressive force upon the element, or by exerting a fluid pressure force directly on the element. Repeated movement of the piston or repeated application of a fluid pressure force on the element may repeatedly radially expand the element, to in turn repeatedly urge the expansion member towards the expansion configuration.

The method may further comprise coupling the expansion tool to a source of pressurised fluid and controlling the flow of pressurised fluid to the element, to control movement of the expansion member towards the expansion configuration. The frequency of movement of the expansion member between the first and expansion configurations may be varied by varying the frequency of pressure pulses supplied to the element.

According to a fifth aspect of the present invention, there is provided a method of expanding tubing, the method comprising the steps of:

locating an expansion tool with respect to tubing to be expanded;

moving an expansion member of the tool from a first configuration towards an expansion configuration;

returning the expansion member towards the first configuration;

translating the tool relative to the tubing; and then moving the expansion member back towards the expansion configuration.

Further features of the method are defined in the attached claims.

BRIEF DESCRIPTION OF THE DRAWINGS

Embodiments of the present invention will now be described, by way of example only, with reference to the accompanying drawings, in which.

DETAILED DESCRIPTION OF DRAWINGS

Figure 1:
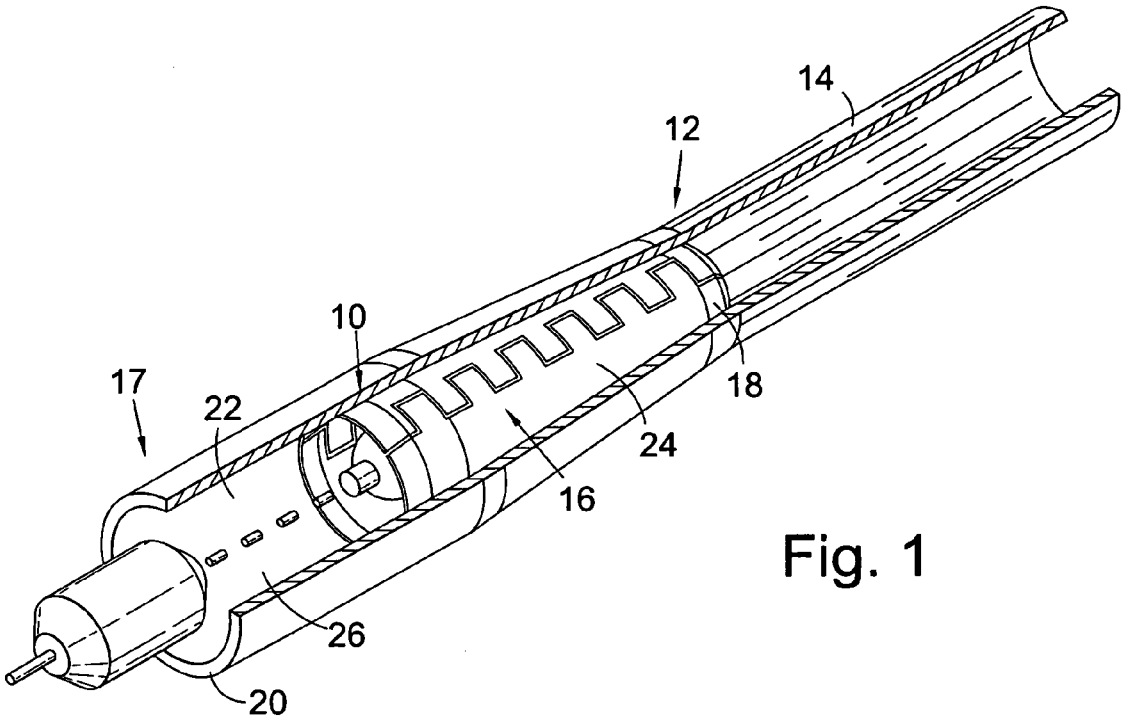
FIG. 1 is a perspective, partially cut-away view of part of an expansion tool in accordance with a preferred embodiment of the present invention, shown during expansion of an expandable tubing.

Turning firstly to FIG. 1, there is shown a tubing expansion tool 10 in accordance with a preferred embodiment of the present invention, shown during expansion of a length of expandable tubing 12. Part of the expandable tubing 12 has been cut away, and parts of the expansion tool 10 removed, for illustration purposes.

The tubing expansion tool 10 can be used for expanding any type of expandable downhole tubing. For example, the tool may be utilized for expanding solid casing or lining, slotted or otherwise perforated tubing, as well as short lengths of tubing such as expandable straddles or patches. However, the tool 10 has particular utility for expanding sand exclusion based tubing, such as the Applicant's commercially available ESS (Trademark) sandscreen. The sandscreen comprises a radially expandable assembly in which overlapping filter sheets are sandwiched between inner expandable support tubing, in the form of a slotted base tubing 14 (FIG. 1), and outer expandable protective tubing. The tool 10 is shown in FIG. 1 during expansion of a length of sandscreen 12, however, only the base tubing 14 is illustrated in the Figure. It will be understood that the tool 10 will typically be used to expand a string of sandscreen tubing sections, which may extend over hundreds or thousands of feet along the length of a borehole.

The expansion tool 10 generally comprises an expansion member 16 adapted for movement between a first configuration and a second larger diameter expansion configuration, and means 17 for exerting a cyclical expansion force on the expansion member 16, to repeatedly urge the expansion member towards the expansion configuration. The expansion member 16 is shown more clearly in FIG. 2, which is a view of parts of the expansion tool 10 of FIG. 1 with the tubing 12 removed. The expansion member is shown in both FIGS. 1 and 2 in the first configuration.

The expansion tool 10 is coupled to a suitable support, such as a string of tubing, run into a borehole (not shown) and located adjacent a string of expandable tubing which has been previously located within the borehole. The tool 10 is then advanced and a leading end 18 of the expansion member 16 enters an end 20 of the uppermost section of the tubing 12, as shown in FIG. 1. The means 17 for exerting a cyclical expansion force is then activated, to repeatedly urge the expansion member 16 towards the expansion configuration, and the tool 10 is translated relative to the tubing 12.

As the expansion member 16 passes into the tubing 12, an outer surface 24 of the expansion member comes into contact with an inner surface 26 of the base tubing 14. When the expansion member 16 is urged towards the expansion configuration, the expansion member induces a permanent deformation of the tubing 12, increasing the tubing diameter. Interaction between the expansion member 16 and the wall of the tubing 12 as the tool 10 passes through the tubing, and partial elastic recovery of the tubing, urges the expansion member back towards the first configuration. By passing the tool 10 through the tubing 12, the tubing is progressively expanded to a larger diameter, due to the tapered shape of the expansion member 16. On completion of the expansion process, the tool 10 is deactivated and pulled out of the borehole.

Figure 2:
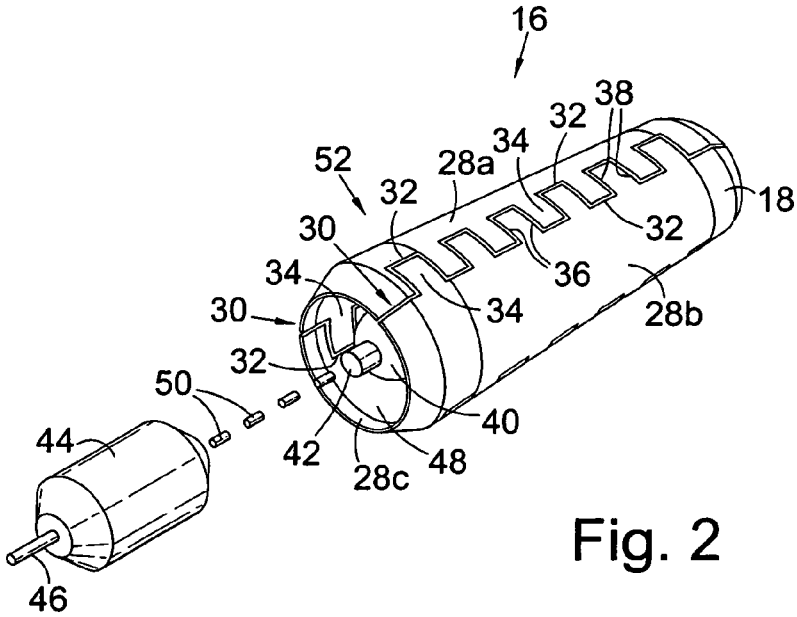
FIG. 2 is a view of an expansion member and part of a means for exerting a cyclical expansion force on the expansion member, forming parts of the expansion tool of FIG. 1.

In more detail, the expansion member 16 comprises a truncated split cone, including three segments 28*a*, 28*b*, and 28*c*, as shown particularly in FIG. 2. These segments 28*a*, 28*b*, 28*c* are interengaged to form the expansion cone 16, which tapers towards the leading end 18 and has a cone angle (the angle between a main axis of the tool and the cone surface) of around 11°.

Axial edges 30 of the segments 28*a*, 28*b*, 28*c* are castellated, defining a saw-tooth type profile with a number of alternate recesses 32 and teeth 34, the teeth 34 of each segment 28*a*, 28*b*, 28*c*, engaging in corresponding recesses 32 of the adjacent segment. Each of the recesses 32 and teeth 34 are generally rectangular, and sidewalls 36 of the recesses 32 lie adjacent side walls 38 of the teeth 34, and are movable with respect to one another. This ensures that the segments 28*a*, 28*b*, 28*c* remain aligned during movement of the expansion member between the first and the expansion configurations, and during translation of the expansion tool 10 through the tubing 12. Expansion of the cone 16 is thus achieved by a relative circumferential separation of the segments 28*a*, 28*b*, 28*c*.

The means 17 for exerting a cyclical expansion force includes an expansion element 40 mounted on a mandrel 42 (only partly shown in the Figures), which is in turn coupled to a flow controller in the form of a modulator 44. The modulator 44 is coupled through a conduit 46 to a fluid pressure source (not shown), at surface or in a separate tool or part of the tool 10, which supplies fluid at a constant pressure to the modulator. The expansion element 40 is hollow and defines an internal chamber (not shown) in fluid communication with the modulator 44 through the mandrel 42, via ports (not shown) in the mandrel. The expansion element 40 is of an elastomeric or rubber material, and is inflatable such that fluid supplied by the modulator 44 to the expansion element 40 inflates and radially expands the element, urging the expansion member 16 towards the expansion configuration.

The modulator 44 supplies fluid pressure pulses to the expansion element as indicated schematically by reference numeral 50. Each pressure pulse 50 inflates the expansion element 40, moving the expansion member 16 to the expansion configuration, and thus expanding the tubing 12. At the end of a pressure pulse, pressurised fluid bleeds out of the element 40, as the expansion member segments 28*a*, 28*b*, 28*c* are forced inwardly by movement of the expansion tool 10 through the tubing 12 and partial elastic recovery. The expansion member 16 is thus moved further down or along the tubing 12 and when the next pressure pulse 50 is supplied to the expansion element 40, a lower section of the tubing 12 is expanded. The frequency of the pressure pulses 50 therefore partly determines the frequency with which the expansion member 16 is urged to the expansion configuration, and thus the rate of expansion of the tubing 12.

It will be understood that the rate of expansion of the tubing 12 is in fact determined by a combination of factors. These include the tubing 12 diameter, the maximum diameter of the expansion cone 16, the cone angle, the frequency of the fluid pressure pulses 50 supplied to the tool, and the force applied to translate the tool through the tubing 12. The leading end 18 of the expansion member is of a slightly smaller diameter than the tubing 12 unexpanded diameter, to allow the tool to enter the tubing. However, the trailing end 52 is of a larger diameter and the tubing 12 is thus ultimately expanded to an internal diameter slightly greater than the diameter of the cone trailing end 52 (in the first configuration of the cone).

Movement of the expansion member 16 between the first and the expansion configurations results in a relatively small localised increase in the internal diameter of the tubing 12, of the order of 1-2 mm. For a 1 mm expansion and with a cone angle of 11°, the unexpanded expansion cone 16 may travel 5 mm along the tubing 12. Thus the cone will move forward at approximately 5 mm per pulse cycle. Assuming a pulse frequency of, for example, 20 Hz, the rate of forward travel will be approximately 6 m per minute.

Expanding the tubing 12 using the expansion tool 10 avoids the requirement to apply relatively large torques to the tool and thus to the tubing, allowing a substantial reduction in the linear force required to translate the tool through the tubing 12, when compared to existing-expansion tools. Also, the tool is relatively simple in its structure, with an anticipated improvement in life and reduction in failure, when compared to existing tools.

Various modifications may be made to the foregoing within the scope of the present invention.

For example, the tubing expansion tool may be rotated, and relatively large forces may be exerted on the tool to translate the tool through tubing, if desired or required.

Alternatively, the element may include a bleed valve or other means to allow pressure reduction. This allows subsequent further expansions generating further movements of the expansion member towards the expansion configuration.

Axial edges of the segments may be of any suitable profile. The expansion tool may further comprise a fixed diameter, semi-compliant or compliant expansion cone or mandrel provided at a leading and/or trailing end of the expansion member, or on a separate part of the tool, for performing an initial and/or final expansion of the tubing.

The expansion element may comprise a substantially solid element, which may be radially expandable by application of a mechanical or fluid pressure force on the element. For example, the means for exerting a force may include a piston adapted to exert a compressive force on the expansion element in a direction along an axis of the tool in response to applied fluid pressure, or may comprise a chamber for receiving fluid to apply a fluid pressure to the element, inducing a radial expansion. The element may be tapered and may define a mandrel adapted to urge the expansion member to the expansion configuration. The element may be movable by application of fluid pressure either directly on the element or, for example, through an actuating piston. The mandrel may be of a fixed diameter or may be radially expandable.

In other embodiments, the element may comprise a cam and the expansion member may comprise a number of cam followers such as rollers or other elements adapted to be moved to the expansion configuration on rotation of the element.

The flow controller may be internal of a main part or body of the tool, or may be external, for example, at surface or further up a string of tubing coupled to the tool. Also, the flow controller may be adapted to receive return flow of fluid from the expansion element, or to allow a reduction in the pressure of fluid in the element, to allow the expansion element to contract. For example, the expansion element may include a bleed valve or other suitable means.

Alternatively or additionally, the means for exerting a cyclical expansion force may be mechanical or mechanically actuated, electro-mechanical (such as electromagnetic) or electro-mechanically actuated, or a combination thereof, or indeed any other suitable means.

The invention claimed is:

1. A tubing expansion tool comprising:

an expansion member that is tubular and comprises a cone having a first configuration and a larger expansion configuration; and means for exerting a cyclical expansion force on the expansion member to repeatedly move the expansion member towards the expansion configuration.

2. A tool as claimed in claim 1, wherein a magnitude and frequency of the expansion force varies over time.

3. A tool as claimed in claim 1, wherein the means for exerting a cyclical expansion force is adapted to exert an expansion force on the expansion member in a cycle of a desired frequency.

4. A tool as claimed in claim 3, wherein a waveform of the expansion force exerted on the expansion member with respect to time is sinusoidal.

5. A tool as claimed in claim 3, wherein a waveform of the expansion force exerted on the expansion member with respect to time is random.

6. A tool as claimed in claim 1, wherein the expansion configuration of the expansion member is a larger diameter configuration.

7. A tool as claimed in claim 1, wherein in the first configuration, the expansion member describes a first outer diameter and in the expansion configuration, a second, larger outer diameter.

8. A tool as claimed in claim 1, wherein the cone is truncated.

9. A tool as claimed in claim 1, wherein the expansion member is tapered at a relatively small angle with respect to an axis of the tool.

10. A tool as claimed in claim 1, wherein at least part of an outer surface of the expansion member is disposed at an angle of between 5-15° with respect to an axis of the tool.

11. A tool as claimed in claim 1, wherein the expansion member comprises a plurality of segments.

12. A tool as claimed in claim 11, wherein each segment is adapted to interengage with an adjacent segment.

13. A tool as claimed in claim 11, wherein each segment is adapted to interengage with an adjacent segment in a sliding fit.

14. A tool as claimed in claim 11, wherein each segment is arcuate.

15. A tool as claimed in claim 11, wherein axial edges of each segment are shaped to cooperate with respective axial edges of adjacent segments.

16. A tool as claimed in claim 11, wherein each segment is castellated and comprises a plurality of teeth and recesses extending along at least part of a length of axial edges of the segment, for engagement with corresponding recesses and teeth, respectively, of an adjacent segment.

17. A tool as claimed in claim 1, comprising a further expansion member at a leading end of the tool.

18. A tool as claimed in claim 1, comprising a further expansion member at a trailing end of the tool.

19. A tool as claimed in claim 17, wherein the further expansion member is selected from the group comprising a fixed diameter, a semi-compliant and a compliant expansion member.

20. A tool as claimed in claim 1, wherein the means for exerting a cyclical expansion force is fluid actuated.

21. A tool as claimed in claim 1, wherein the expansion member is adapted to be urged towards the expansion configuration in response to applied fluid pressure.

22. A tool as claimed in claim 1, wherein the expansion member is adapted to be urged towards the expansion configuration in response to fluid flow with respect to the tool.

23. A tool as claimed in claim 1, wherein the expansion member is adapted to be urged towards the expansion configuration in response to the inertia of a moving fluid column.

24. A tool as claimed in claim 1, wherein the means for exerting a cyclical expansion force is at least partly mechanical.

25. A tool as claimed in claim 1, wherein the means for exerting a cyclical expansion force is at least partly electro-mechanical.

26. A tool as claimed in claim 1, wherein the means for exerting a cyclical expansion force is at least partly electro-magnetic.

27. A tool as claimed in claim 1, wherein the means for exerting a cyclical expansion force comprises an element adapted to be radially expanded to urge the expansion member towards the expansion configuration.

28. A tool as claimed in claim 27, wherein the element is adapted to be expanded and contracted by controlling the supply of pressure pulses to the element.

29. A tool as claimed in claim 27, wherein the element is located radially inwardly of the expansion member.

30. A tool as claimed in claim 27, wherein the element is located within the expansion member.

31. A tool as claimed in claim 27, wherein the element is elastically deformable.

32. A tool as claimed in claim 31, wherein the element is at least partly of an elastomeric material.

33. A tool as claimed in claim 31, wherein the element is at least partly of a rubber material.

34. A tool as claimed in claim 27, wherein the element is inflatable.

35. A tool as claimed in claim 27, wherein the element is at least partly hollow, defining a chamber adapted for inflation in response to applied fluid pressure.

36. A tool as claimed in claim 27, wherein the element is substantially solid, and is expandable by application of a force on the element in a predetermined direction, to induce a radial expansion of the element.

37. A tool as claimed in claim 36, wherein the means for exerting a cyclical expansion force includes a piston adapted to exert a compressive force on the element in a direction along an axis of the tool in response to applied fluid pressure.

38. A tool as claimed in claim 36, wherein the means for exerting a cyclical expansion force includes a chamber for receiving fluid to apply a fluid pressure to the element.

39. A tool as claimed in claim 1, wherein the means for exerting a cyclical expansion force includes a tapered mandrel adapted for axial movement to urge the expansion member to the expansion configuration.

40. A tool as claimed in claim 1, wherein the means for exerting a cyclical expansion force comprises a cam and the expansion member comprises at least one cam follower adapted to be moved to the expansion configuration on rotation of the cam.

41. A tool as claimed in claim 1, wherein the means for exerting a force includes a fluid flow controller for controlling movement of the expansion member to the expansion configuration.

42. A tool as claimed in claim 41, wherein the flow controller is internal of a main part of the tool.

43. A tool as claimed in claim 41, wherein the flow controller is external of a main part of the tool.

44. A tool as claimed in claim 41, wherein the flow controller is adapted to supply a pulse of pressurised fluid to move the expansion member to the expansion configuration.

45. A tool as claimed in claim 41, wherein the flow controller is adapted to receive return flow of fluid to facilitate movement of the expansion member to the first configuration.

46. A tool as claimed in claim 41, wherein the means for exerting a cyclical expansion force comprises an element adapted to be radially expanded to urge the expansion member towards the expansion configuration, and wherein the flow controller is fluidly coupled to the element.

47. A tool as claimed in claim 46, wherein the flow controller is adapted to supply fluid to the element to inflate and radially expand the element, and to allow a reduction in the pressure of fluid in the element, to allow the element to contract.

48. A tool as claimed in claim 46, wherein the flow controller is adapted to provide a pulsed output to the element.

49. A tool as claimed in claim 41, wherein the flow controller is coupled to a fluid source, for the supply of fluid to the controller.

50. A tool as claimed in claim 41, wherein the flow controller is adapted to generate fluid pressure pulses in a cycle corresponding to a desired frequency of movement of the expansion member between the first and the expansion configurations.

51. A tool as claimed in claim 1, wherein the means for exerting a cyclical expansion force comprises an element adapted to be radially expanded to urge the expansion member towards the expansion configuration, the means further comprising a bleed valve to allow pressure reduction.

52. A tubing expansion tool, comprising:

an expansion member having a first configuration and a larger expansion configuration; and means for exerting a cyclical expansion force on the expansion member to repeatedly move the expansion member towards the expansion configuration, wherein a waveform of the expansion force exerted on the expansion member with respect to time is one of square and sinusoidal.

53. A method of expanding tubing, the method comprising the steps of:

locating an expansion tool with respect to tubing to be expanded, with an expansion member of the tool in a first configuration, wherein the expansion member has an outer surface that tapers in all the configurations and contacts the tubing during expanding;

exerting a cyclical expansion force on the expansion member, to repeatedly urge the expansion member towards an expansion configuration; and translating the expansion tool relative to the tubing.

54. A method as claimed in claim 53, comprising coupling a plurality of expansion member segments together to form the expansion member.

55. A method as claimed in claim 53, comprising expanding an element located within the expansion member to urge the expansion member towards the expansion configuration.

56. A method as claimed in claim 53, comprising applying a fluid pressure force to exert the cyclical expansion force on the expansion member.

57. A method as claimed in claim 53, comprising applying fluid pressure pulses to exert the cyclical expansion force on the expansion member.

58. A method as claimed in claim 56, comprising applying fluid pressure to an expansion element to move the expansion member towards the expansion configuration.

59. A method as claimed in claim 55, comprising expanding the element by exerting a force upon the element.

60. A method as claimed in claim 59, comprising expanding the element by supplying pressurised fluid to a piston, to exert a compressive force upon the element.

61. A method as claimed in claim 60, comprising expanding the element by exerting a fluid pressure force directly on the element.

62. A method as claimed in claim 53, comprising coupling the expansion tool to a source of pressurised fluid and controlling the flow of pressurised fluid, to control movement of the expansion member towards the expansion configuration.

63. A method as claimed in claim 53, wherein the frequency of movement of the expansion member between the first and expansion configurations is varied by varying a frequency of fluid pressure pulses supplied to exert the cyclical expansion force on the expansion member.

64. A method as claimed in claim 53, comprising mechanically exerting the cyclical expansion force on the expansion member.

65. A method as claimed in claim 53, comprising electromagnetically exerting the cyclical expansion force on the expansion member.

66. A method as claimed in claim 53, comprising a method of expanding downhole tubing.

67. A method as claimed in claim 53, comprising exerting a force on the expansion member to return the expansion member towards the first configuration.

68. A method as claimed in claim 67, comprising providing apparatus for exerting a force on the expansion member to return the expansion member towards the first configuration.

69. A method as claimed in claim 53, wherein a rate of expansion of the tubing is at least partly determined by a frequency of movement of the expansion member between the first configuration and the expansion configuration.

70. A method as claimed in claim 53, wherein the expansion member has an outer surface that tapers in all the configurations and contacts the tubing during expanding.

71. A method as claimed in claim 53, wherein translating the expansion tool progresses the expansion tool along the tubing corresponding to progressive expansion of the tubing caused by exerting the cyclical expansion force.

72. A method as claimed in claim 53, wherein the translating disposes the expansion member in contact with a progressive section of the tubing to be expanded upon return of the expansion member toward the first configuration.

73. A method as claimed in claim 53, wherein translating the expansion tool progressively expands a length of the tubing as the expansion tool travels through the length of the tubing.

74. A method of expanding tubing, the method comprising the steps of:

locating an expansion tool with respect to tubing to be expanded, with an expansion member of the tool in a first configuration;

exerting a cyclical expansion force on the expansion member, to repeatedly urge the expansion member towards an expansion configuration; and translating the expansion tool relative to the tubing, wherein the expansion member is returned towards the first configuration by translating the tool through the tubing.

75. A tubing expansion tool comprising:

an expansion member having tapered segments defining a retracted configuration and a larger expansion configuration, wherein the segments in both the configurations form a cone shape; and a cyclical actuator coupled to the segments to exert recurring force pulses on the segments urging the segments repeatedly toward the expansion configuration, wherein the tapered segments are repeatedly moveable toward the retracted configuration between the force pulses.

* * * * *